US007169991B2

(12) United States Patent
Ralbovsky

(10) Patent No.: US 7,169,991 B2
(45) Date of Patent: Jan. 30, 2007

(54) GUITAR

(76) Inventor: Journey M. Ralbovsky, General Delivery, Pine Hill, NY (US) 12465

( * ) Notice: Subject to any disclaimer, the term of this patent is extended or adjusted under 35 U.S.C. 154(b) by 24 days.

(21) Appl. No.: 10/786,784

(22) Filed: Feb. 25, 2004

(65) Prior Publication Data

US 2005/0045017 A1 Mar. 3, 2005

Related U.S. Application Data

(60) Provisional application No. 60/498,401, filed on Aug. 28, 2003.

(51) Int. Cl.
*G10D 3/00* (2006.01)

(52) U.S. Cl. ..... 84/291; 84/267

(58) Field of Classification Search ..... 84/291, 84/267, 290; D17/14, 15, 19
See application file for complete search history.

(56) References Cited

U.S. PATENT DOCUMENTS

| | | | | | |
|---|---|---|---|---|---|
| 4,351,217 | A * | 9/1982 | Wechter | ..... | 84/743 |
| 5,749,768 | A * | 5/1998 | Green | ..... | 450/65 |
| 5,952,591 | A * | 9/1999 | Thurman | ..... | 84/267 |
| 6,034,308 | A * | 3/2000 | Little | ..... | 84/291 |

* cited by examiner

*Primary Examiner*—Lincoln Donovan
*Assistant Examiner*—Jianchun Qin
(74) *Attorney, Agent, or Firm*—Pearne & Gordon LLP

(57) ABSTRACT

An acoustical guitar characterized by a relieved formation in a side edge and adjacent back portion of the guitar, the relieved portion being shaped to provide space for the breast of an instrumentalist, whereby pressure against the breast of the instrumentalist is relieved during use of the guitar. The relieved formation may be a cup-shaped member designed to fit the breast size of a female instrumentalist.

5 Claims, 3 Drawing Sheets

GUITAR

CROSS-REFERENCE TO RELATED APPLICATION

This application claims the benefit of provisional application Ser. No. 60/498,401 filed on Aug. 28, 2003 which is hereby incorporated by reference in its entirety.

TECHNICAL FIELD

The present invention relates generally to musical instruments, and more specifically to acoustical guitars constructed to substantially increase comfort for the human anatomy and to make it easier to play acoustical guitars.

BACKGROUND OF THE INVENTION

Because of the way the back of an acoustic guitar is pressed against the breast of an instrumentalist, playing of the guitar can be difficult and uncomfortable. Women, especially, often cannot practice as long as desired because of the pain which results. As hereinafter discussed in more detail, other problems caused by conventional guitars include improper posture, an inability to sing properly as a result of distorted posture and the commonly accepted position of EQ panels. These problems have been discussed for years, but have been left unnoticed and unaddressed by guitar companies throughout the long history of guitar making.

Technically speaking, when playing the acoustical guitar "in position", there are three choices. One choice is for the player to rest her or his breast against the first upper curve of the back of the guitar. Unfortunately, this is where several guitar companies place the EQ panels. The breast can involuntarily turn the knobs during performance. Then there also exists a subtle change or contortion of the rib cage and the spine that takes place in order to accommodate the instrument. This leads to improper posture and is not conducive to proper singing technique. As any highly trained vocalist knows, vocal chords are an extremely touchy, delicate and precise instrument. They require space and freedom of movement in the entire body for ultimate projection. For those singers/song writers who use the guitar as a tool for momentum and interaction of chords and melodic structure of the song, physical distortion of the body brought on by use of conventional guitars is very serious. A second alternative is simply to place the guitar where its line jabs into the side of the breast. A third alternative is for a female player, but not necessarily a male player, to push herself down and left into the center of the back of the guitar. This is a constrictive position and causes tightening of the chest. Again, this is not conducive to good singing performance and can lead to an early onset of osteoporosis because of the slouch that the player assumes.

SUMMARY OF THE INVENTION

An object of this invention is to provide a new and improved acoustical guitar construction that overcomes the problems discussed above and substantially increases comfort for the human anatomy, especially the female. The invention makes it easier to play an acoustical guitar and leads to improved performance by a singer/guitar player.

This objective is achieved by forming a portion of the back and adjacent side edge of the guitar to conform with the breast area of the instrumentalist. In a preferred construction, the breast-accommodating formation is a molded insert. The molded insert can be customized to conform to the breast size, e.g. A, B or C cup, of a female instrumentalist. An alternative is simply to form a "universal" cup indention in the back of the guitar. In yet another embodiment, the wood on the back of the guitar provides a space or hole for clearance of the chest.

DESCRIPTION OF PREFERRED EMBODIMENT

Figure 1:
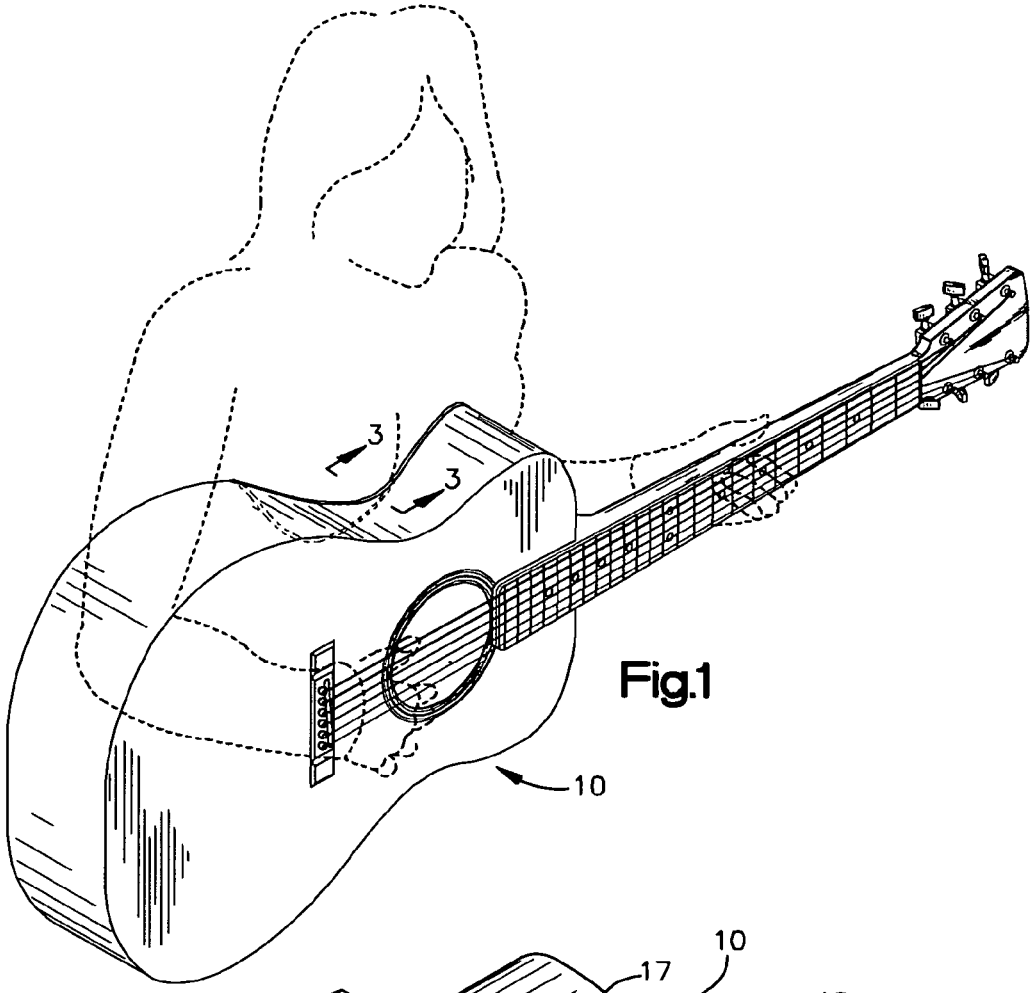
FIG. 1 is a perspective view showing the new guitar in use.
Figure 2:
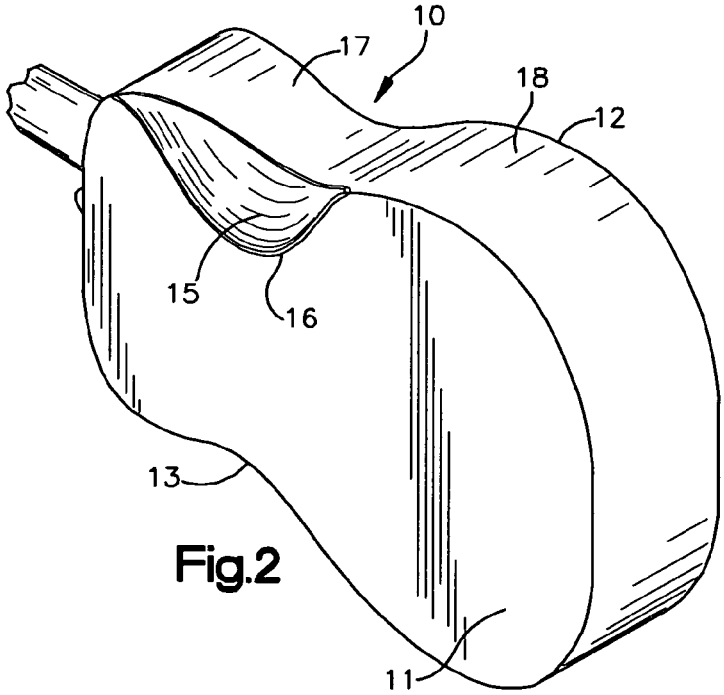
FIG. 2 is a perspective view showing the back and sides of a referred embodiment.

Referring now to the drawings and to FIGS. 1–5 in particular, there is shown an acoustical guitar 10 made according to a preferred embodiment of the invention. The guitar 10 has a back 11 and sides 12, 13.

In accordance with the invention, a portion of the back 11 and the side 12 are formed with a relieved area or indention 15 which is generally cup-shaped. In the case of a female instrumentalist shown in FIGS. 1 and 3, the formation 15 is shaped to accommodate her breast. As shown, the edge 16 of the cup-shaped indention 15 curves from the upper right hand shoulder bout 17 of the side 12 toward the center line of the guitar back 11 and then out to the lower bout in a wave shape.

In the preferred embodiment of the invention, the breast-accommodating indention 15 is an insert made of any suitable material, such as wood, thin metal or plastic. Preferably, it is made from a material such as a fiber reinforced plastic or other material that can be molded. The insert forming the area 15 can be custom molded to fit the breast of a female user. The insert can be of any desired cup size, e.g. A, B or C to accommodate a particular person, or it can simply be one universal size.

In making the guitar 10, a portion of the back 11 and the side 12 of the guitar is cut out and the molded insert 15 is secured in place to form the breast-accommodating indention. When personalizing the guitar 10, the size of the cup-shaped indention 15 simply involves trying out various sizes for a specific user to determine which one feels the most comfortable. The selected insert is then secured in place in any suitable manner.

Figure 3:
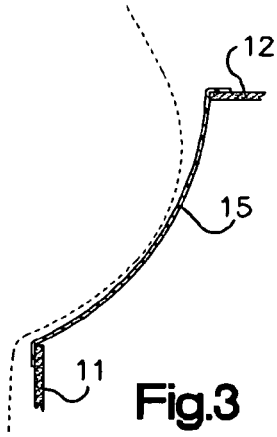
FIG. 3 is a fragmentary view taken in the plane 3—3 of FIG. 1.
Figure 4:
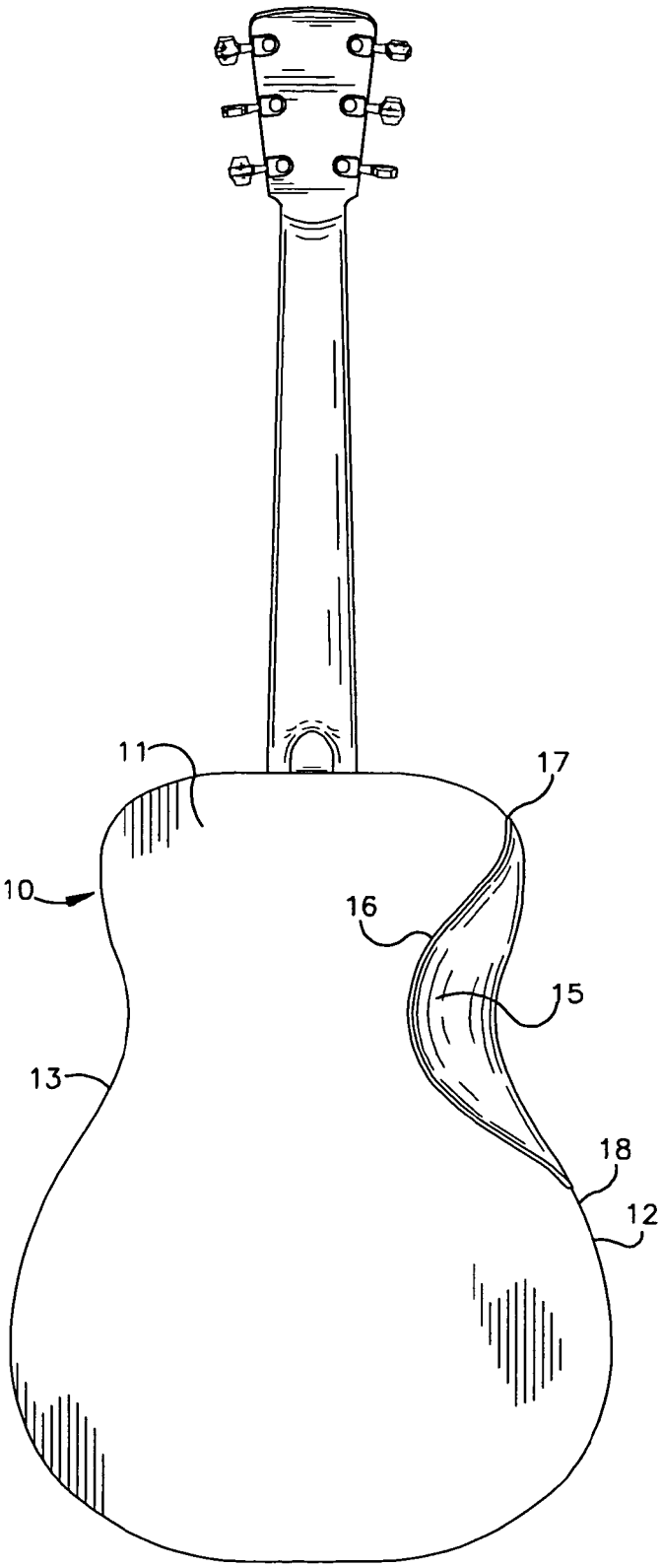
FIG. 4 is a back elevational view of the guitar.
Figure 5:
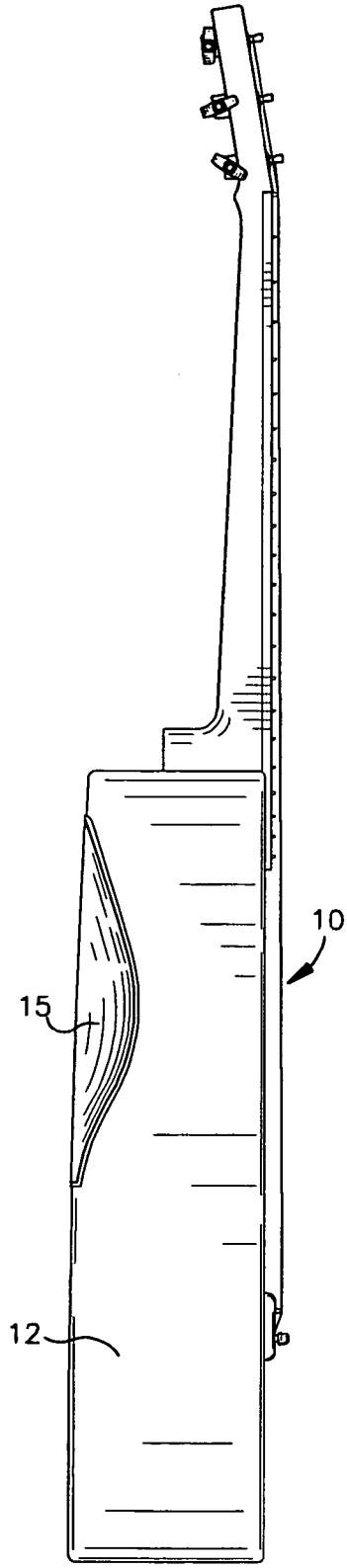
FIG. 5 is a side elevational view of the guitar.

As shown in FIGS. 1 and 3, the cup-shaped insert 15 conforms to the breast of the female instrumentalist. The guitar "hugs" the user so that she is more connected to the sound. The guitar is very comfortable to use and can be played for hours without discomfort. It will be apparent that the user is not required to alter her physical position from one that is most conducive to proper singing and posture.

Figure 6:
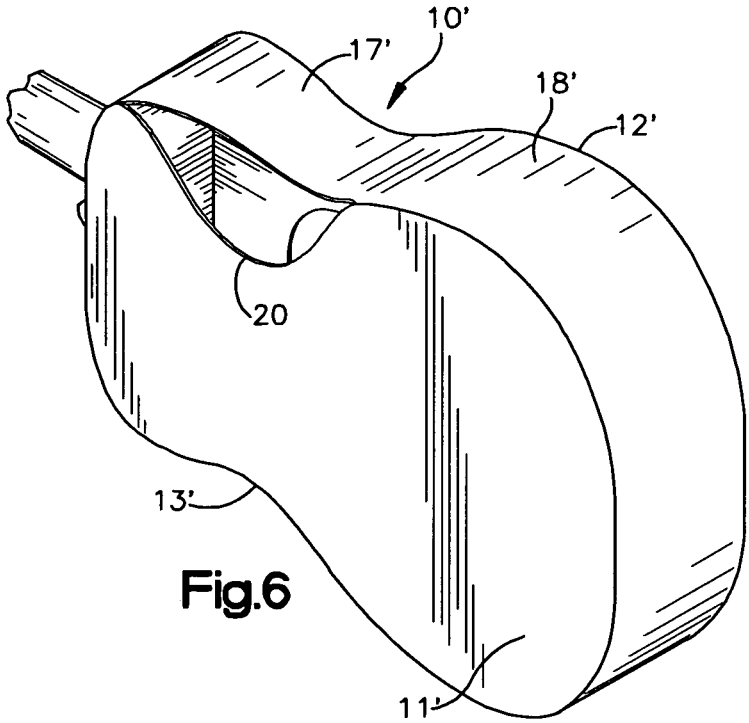
FIG. 6 is an elevational view of the back of an acoustical guitar formed in accordance with another embodiment of the invention.
Figure 7:
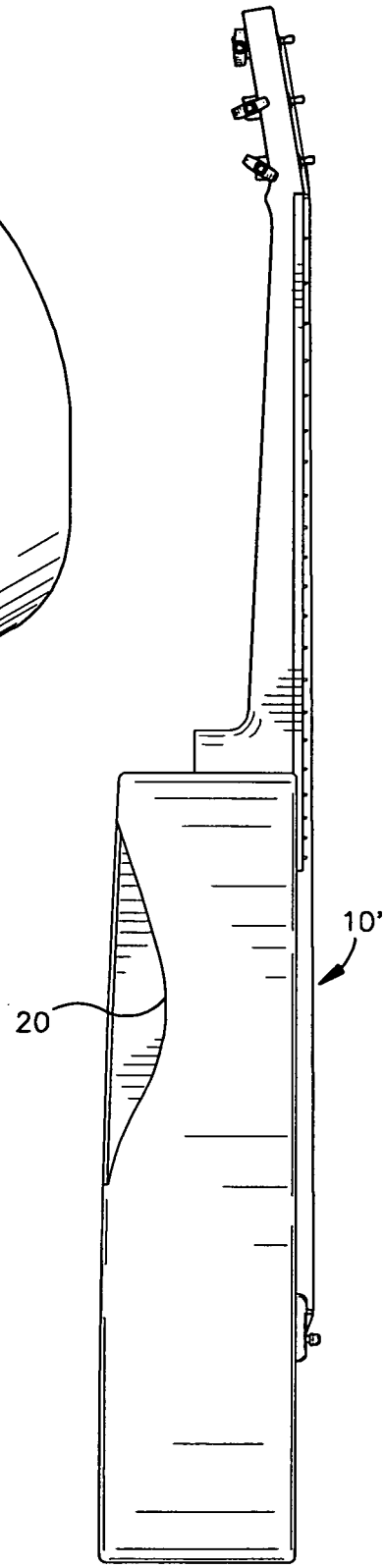
FIG. 7 is a side elevational view of the guitar shown in FIG. 6.

In an alternative construction shown in FIGS. 6 and 7, a guitar 10' has its back 11' and right side 12' cut out to provide a breast-accommodating hole 20. As in the case of the guitar 10, the edge 16' of the hole 20 curves from the upper right hand shoulder bout 17' toward the center of the guitar back and then out to the lower right hand bout 18' in a wave shape. The hole 20 performs the desired function of relieving pressure against the breast of the instrumentalist.

Many modifications and variations of the invention will be apparent to those skilled in the art in view of the foregoing disclosure. Therefore, it is to be understood that, within the scope of the appended claims, the invention can be practiced otherwise than as specifically shown and described.

The invention claimed is:

1. A method of making an acoustic guitar comprising the steps of providing an opening through the back of a guitar adjacent its upper edge when held in playing position, forming a generally cup-shaped insert shaped to receive a female breast, and mounting said insert in said opening in position to receive the breast of a player when the guitar is held in playing position.

2. The method as claimed in claim 1 wherein said step of forming said insert includes customizing said insert to fit the specific breast size of a female instrumentalist.

3. In an acoustic guitar having a back and side surfaces, one of said side surfaces having upper and lower right hand bouts when the guitar is held in playing position, the improvement comprising a recess member in the form of a generally cup-shaped indention shaped to receive the breast of a female player when the guitar is held against the chest, said recess member being inserted in said back surface adjacent the upper side surface between said upper right hand bout and said lower right hand bout.

4. An acoustic guitar as claimed in claim 3 wherein said recess member is cup-shaped to conform to a specific breast size of an intended user of said guitar.

5. In an acoustic guitar having a back and side surfaces, one of said side surfaces having upper and lower right hand bouts when the guitar is held in playing position, the improvement comprising a recess of a size and shape to receive the breast of a female player when the guitar is held against the chest, said recess being a hole in said back surface adjacent the upper side surface when the guitar is held in playing position, said hole being located between said upper right hand bout and said lower right hand bout in position to receive the breast of a female player.

* * * * *